US008668267B2

(12) United States Patent
Piretti

(10) Patent No.: US 8,668,267 B2
(45) Date of Patent: Mar. 11, 2014

(54) CHAIR WITH TILTING BACKREST

(75) Inventor: Alessandro Piretti, Bologna (IT)

(73) Assignee: Pro-Cord S.p.A., Bologna (IT)

( * ) Notice: Subject to any disclaimer, the term of this patent is extended or adjusted under 35 U.S.C. 154(b) by 335 days.

(21) Appl. No.: 13/179,462

(22) Filed: Jul. 8, 2011

(65) Prior Publication Data

US 2012/0013163 A1 Jan. 19, 2012

(30) Foreign Application Priority Data

Jul. 15, 2010 (EP) ..... 10425237

(51) Int. Cl.
*A47C 1/024* (2006.01)
*A47C 3/00* (2006.01)

(52) U.S. Cl.
USPC ..... 297/301.5; 297/301.3

(58) Field of Classification Search
USPC ..... 297/301.1, 301.3, 301.5, 300.1, 300.4, 297/300.6, 302.1, 302.3, 302.5, 285
See application file for complete search history.

(56) References Cited

U.S. PATENT DOCUMENTS

| | | | | |
|---|---|---|---|---|
| 3,290,091 | A * | 12/1966 | Goodman | 297/302.5 |
| 4,585,272 | A * | 4/1986 | Ballarini | 297/284.3 |
| 5,320,410 | A * | 6/1994 | Faiks et al. | 297/296 |
| 5,660,439 | A * | 8/1997 | Unwalla | 297/316 |
| 6,406,096 | B1 * | 6/2002 | Barile, Sr. | 297/301.3 |
| 6,896,327 | B1 * | 5/2005 | Barile, Sr. | 297/297 |
| 8,388,064 | B2 * | 3/2013 | Bertolini et al. | 297/299 |
| 8,414,073 | B2 * | 4/2013 | Schmitz et al. | 297/321 |
| 2005/0001462 | A1 * | 1/2005 | Spendlove et al. | 297/301.5 |

FOREIGN PATENT DOCUMENTS

| | | |
|---|---|---|
| DE | 4428244 A1 | 2/1996 |
| EP | 1557115 A1 | 7/2005 |
| FR | 1381540 | 12/1964 |
| GB | 2084456 A | 4/1982 |

OTHER PUBLICATIONS

Eurpean Search Report for Application No. 10425237.4 dated Feb. 8, 2011.

* cited by examiner

*Primary Examiner* — Milton Nelson, Jr.
(74) *Attorney, Agent, or Firm* — Patterson & Sheridan, L.L.P.

(57) ABSTRACT

A chair comprising a basic structure, a seat, a backrest, and at least one joint made of plastic material, which connects the backrest to the basic structure, wherein the joint has a first connection portion fixed to or integral with respect to the backrest, and a second connection portion connected to the basic structure, wherein said second connection portion comprises a first and a second arm, which are elongated in a longitudinal direction and are set at a distance from one another in a vertical direction, wherein the first arm has a front portion fixed to the basic structure and is deformable between a resting position corresponding to the resting position of the backrest and a deformed position corresponding to the position where the backrest is tilted backwards, wherein the second arm has a front portion, which is mobile in a longitudinal direction with respect to the basic structure between a first position corresponding to the resting position of the first arm, and a second position corresponding to the deformed position of the first arm, and wherein the second arm and the basic structure are provided with respective arrest elements which limit the extent of the travel in a longitudinal direction of the front portion of the second arm and define an end-of-travel of tilting backwards of the backrest.

15 Claims, 9 Drawing Sheets

CHAIR WITH TILTING BACKREST

CROSS-REFERENCE TO RELATED APPLICATIONS

This application claims benefit of European patent application serial number 10425237.4, filed Jul. 15, 2010, which is herein incorporated by reference.

BACKGROUND OF THE INVENTION

1. Field of the Invention

The present invention relates to a chair with tilting backrest.

More precisely, the invention regards a chair comprising a basic structure, a seat carried by the basic structure, a backrest, and at least one joint made of plastic material that connects the backrest to the basic structure, wherein the joint has a first connection portion fixed or integral with respect to the backrest, and a second connection portion connected to the basic structure, and wherein the joint is elastically deformable to enable a movement of the backrest between a resting position and a position tilted backwards under a thrust backwards applied by the user.

2. Description of the Related Art

The document No. EP-A-1557115 filed in the name of the same applicant describes a chair with tilting backrest, in which the backrest has two relatively stiff lateral uprights and two connection elements formed integrally with the bottom ends of the uprights. The lateral connection elements are substantially L-shaped with a horizontal fixing portion fixed to the supporting structure of the chair. The connection elements are elastically compliant to enable a tilting backwards of the backrest under a thrust backwards applied by the user.

The chief drawback of the solution described in the document No. EP 1557115 is that the elastically compliant connection elements that connect the backrest to the basic structure of the chair are not provided with an end-of-travel that limits the inclination backwards of the backrest.

SUMMARY OF THE INVENTION

The object of the present invention is to provide a chair with tilting backrest with an elastically deformable joint that connects the backrest to the supporting structure of the chair, where the joint is provided with an end-of-travel that limits the inclination backwards of the backrest having a simple and inexpensive structure.

According to the present invention, said subject is achieved by a chair having the characteristics that form the subject of claim 1.

BRIEF DESCRIPTION OF THE DRAWINGS

The present invention will now be described in detail with reference to the attached drawings, which are provided purely by way of non-limiting example and in which.

DETAILED DESCRIPTION

Figure 1:
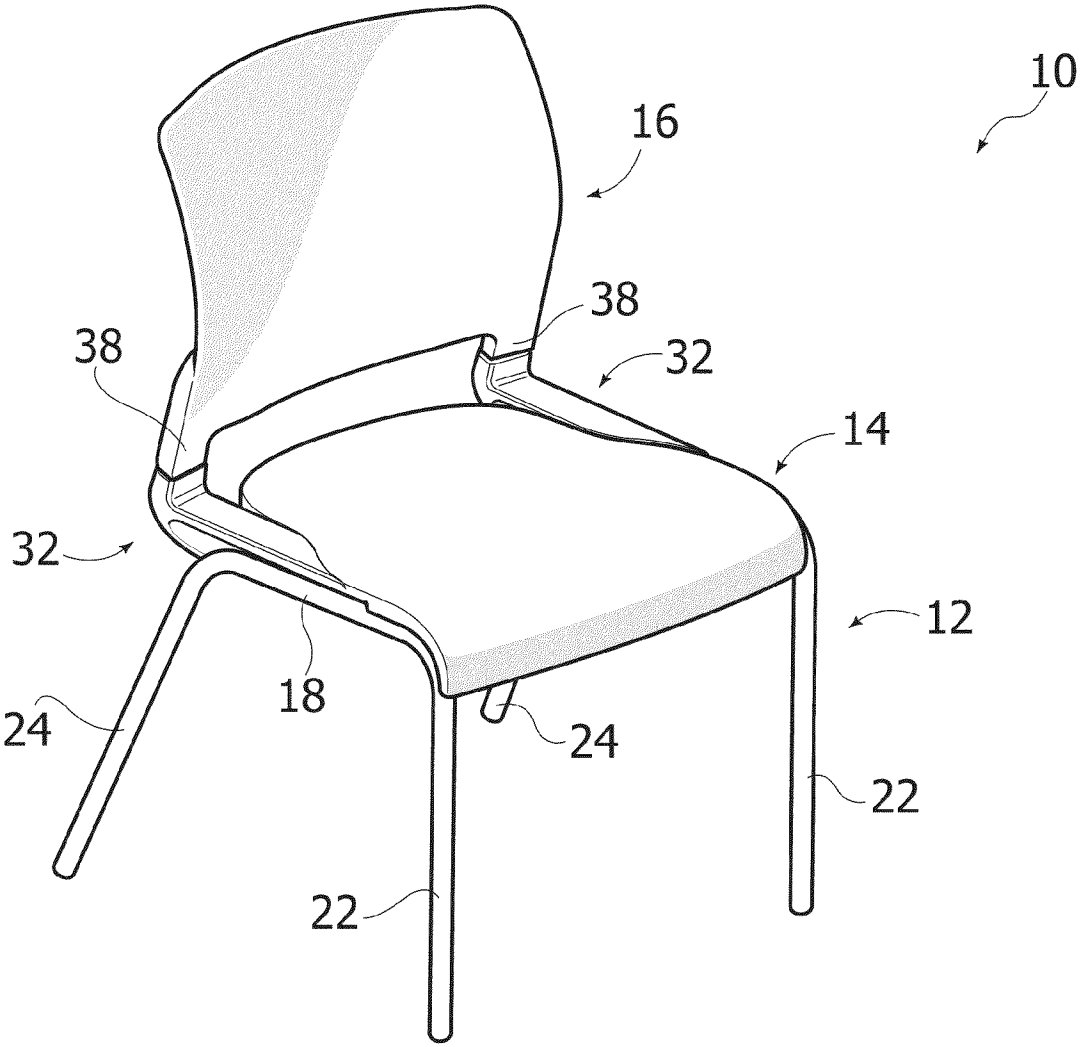
FIG. 1 is a perspective view of an embodiment of a chair according to the present invention.
Figure 2:
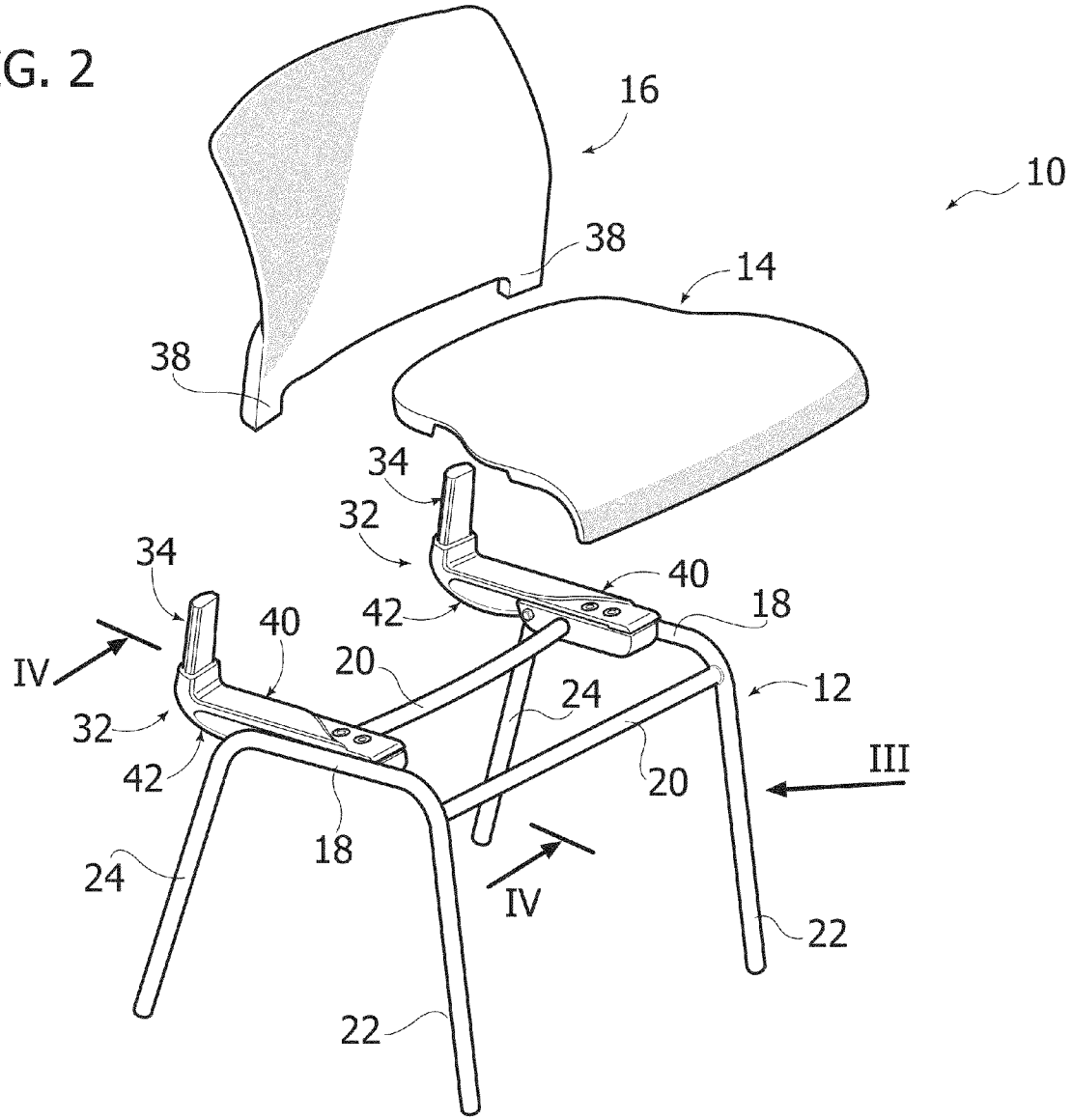
FIG. 2 is an exploded perspective view of the chair of FIG. 1.

With reference to FIGS. 1 and 2, designated by 10 is a chair according to the present invention. The chair 10 comprises a basic structure 12 that carries a seat 14 and a backrest 16.

In the example illustrated the basic structure 12 comprises two lateral elements 18, which are joined to one another by transverse elements 20 and carry respective front legs 22 and rear legs 24. This arrangement is not, however, limiting and may be varied according to the requirements. For example, in the case of an office chair, the basic structure 12 could be formed by a height-adjustable central upright, provided at its bottom end with radial arms, which carry swivel wheels.

Figure 3:
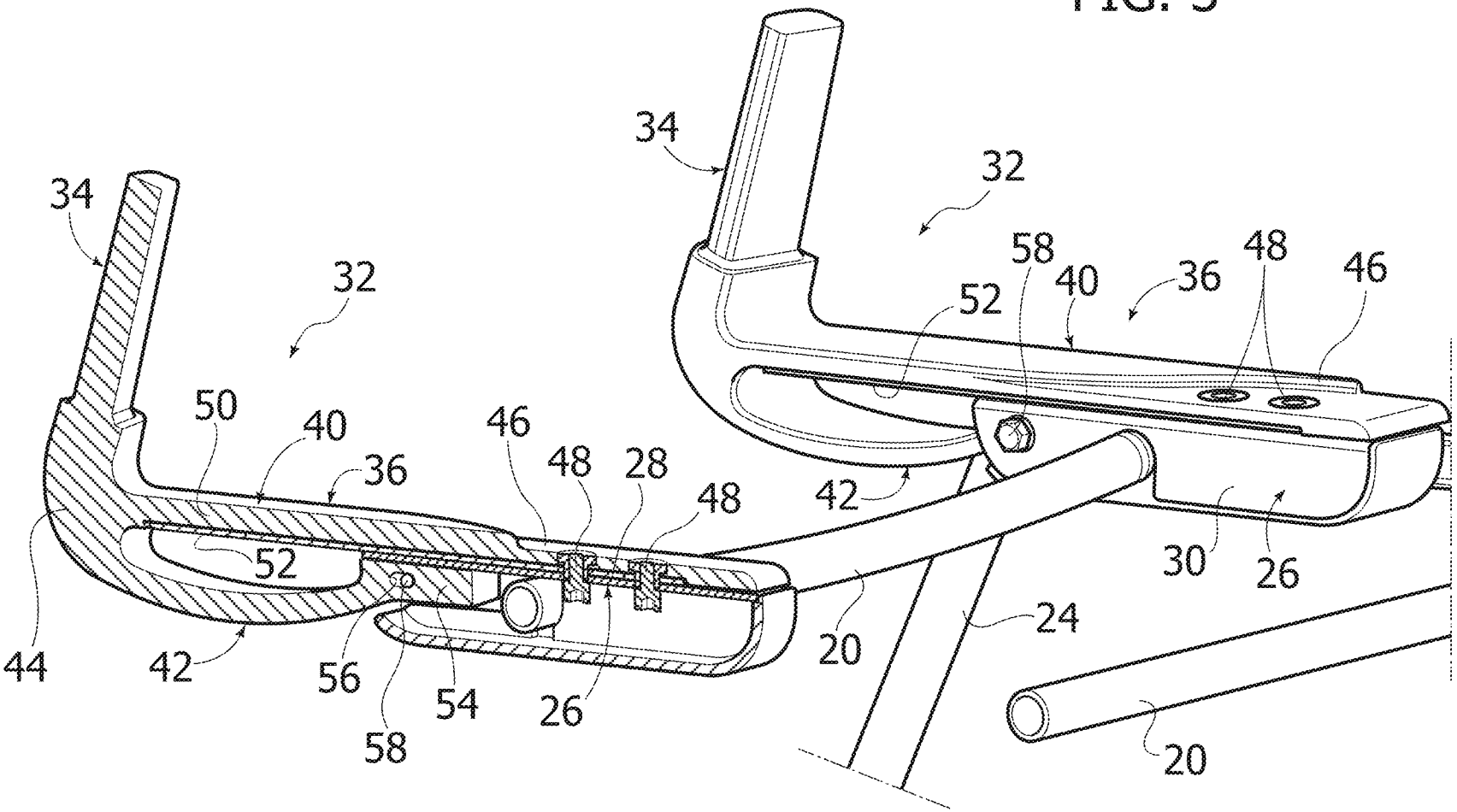
FIG. 3 is a perspective view of the basic structure indicated by the arrow III in FIG. 2.

With reference to FIG. 3, in the example illustrated the basic structure 12 comprises two C-shaped metal brackets 26 fixed to the respective lateral elements 18 and to the rear transverse element 20. Each of the two brackets 26 has a horizontal top wall 28 and two sides 30 that extend downwards from the wall 28.

Figure 4:
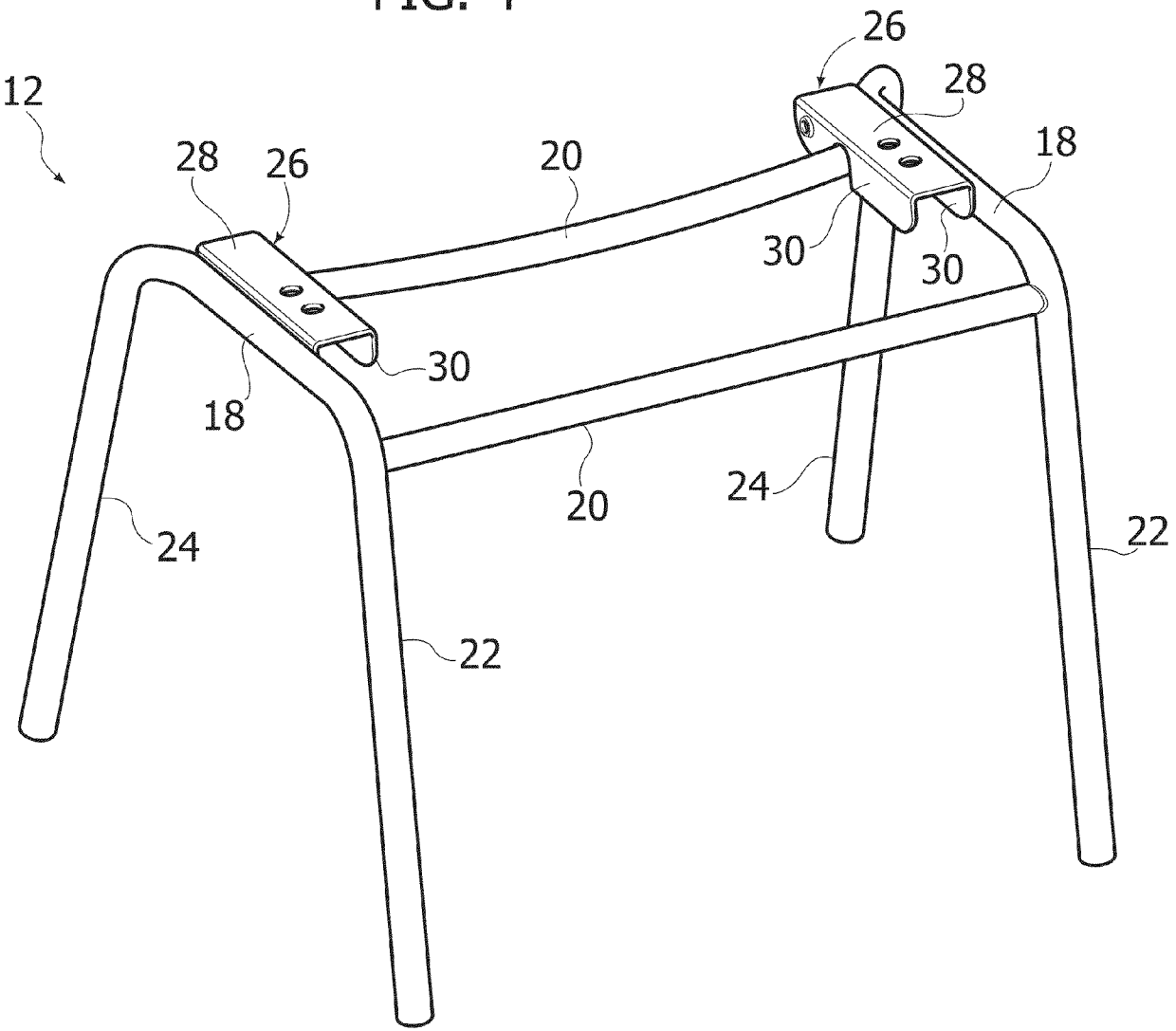
FIG. 4 is a perspective view partially sectioned according to the line IV-IV of FIG. 2.

With reference to FIGS. 1, 2 and 4, the chair 10 comprises two elastically deformable joints 32 that connect the backrest 16 to the basic structure 12. The fact of providing two joints 32 is not imperative. In other embodiments, such as for example in the case of an office chair, there may be provided a single joint 32 set centrally.

Each joint 32 is preferably constituted by a monolithic body of plastic material. Each joint 32 has a first connection portion 34 fixed to or formed integrally with the backrest 16, and a second connection portion 36 connected to the basic structure 12 in the way that will be described in what follows. In the example illustrated, the first connection portions 34 of the joints 32 are inserted and fixed within respective bottom lateral portions 38 of the backrest 16. Alternatively, the connection portions 34 could be formed integrally with the bottom lateral portions of the backrest 16.

The second connection portion 36 of each joint 32 comprises a first arm 40 and a second arm 42. The arms 40, 42 extend in a longitudinal direction and are set at a distance from one another in a vertical direction. The first and second arms 40, 42 have respective rear ends that are joined to a bottom end 44 of the first connection portion 34. The first arm 40 has a front portion 46 fixed to a respective bracket 26 of the basic structure 12, for example by means of screws 48 that engage respective holes formed in the horizontal wall 28 of the respective bracket 26. The first arm 40 has a rear portion 50 that projects in cantilever fashion from the rear end of the respective bracket 26 and is elastically deformable with respect to the front portion 46.

An elastic lamina 52 of metal material can be set between a bottom face of the first arm 40 and the horizontal wall 28 of the respective bracket 26. The elastic lamina 52, if present, extends in cantilever fashion towards the rear part beyond the bracket 26 and underneath the rear portion 50 of the first arm 40. The elastic lamina 52 can be fixed to the respective bracket 26 by means of the same screws 48 that fix the first arm 40 to the respective bracket 26.

The second arm 42 has a front portion 54 that is mobile in a longitudinal direction with a travel of limited extent with respect to the respective bracket 26. The front portion 54 of the second arm 42 is shaped like a sliding block and is inserted in such a way as to slide between the sides 30 and the wall 28 of the respective bracket 26, which form a guide elongated in a longitudinal direction.

The front portion 54 of the second arm 42 and the respective bracket 26 are provided with arrest elements that cooperate with one another and limit the extent of the movement in a longitudinal direction of the front portion 54. In the embodiment illustrated, said arrest elements are made in the form of a pin-and-slit coupling. More specifically, the front portion 54 is provided with a slot 56 elongated in a longitudinal direction in which a pin 58 fixed to the bracket 26 engages. In the example illustrated, the pin 58 extends in a direction orthogonal to the sides 30 of the bracket 26.

The length in a longitudinal direction of the slot 56 defines the maximum extent of the movement in a longitudinal direction of the front portion 54 of the second arm 42.

Figure 6:
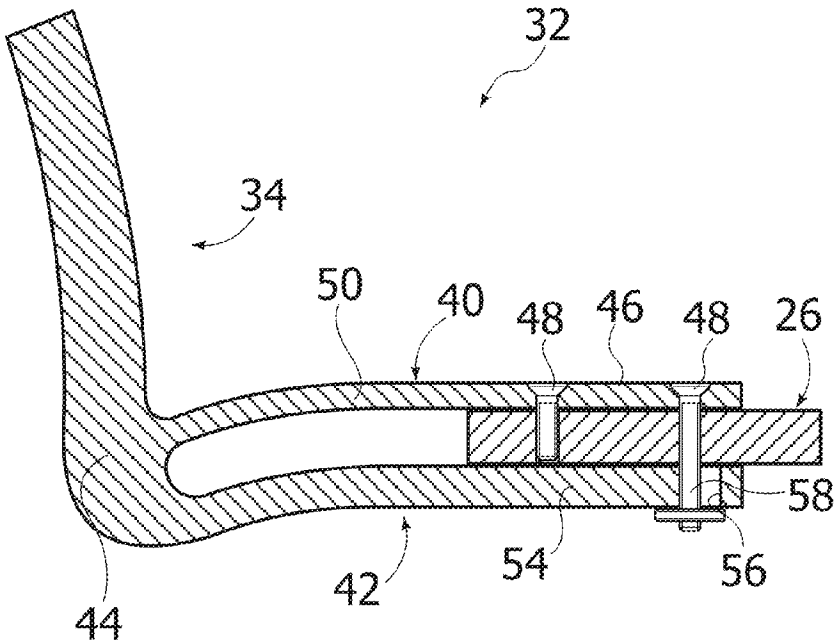
FIGS. 5 and 6 are schematic sections illustrating operation of the chair according to the present invention.
Figure 5:
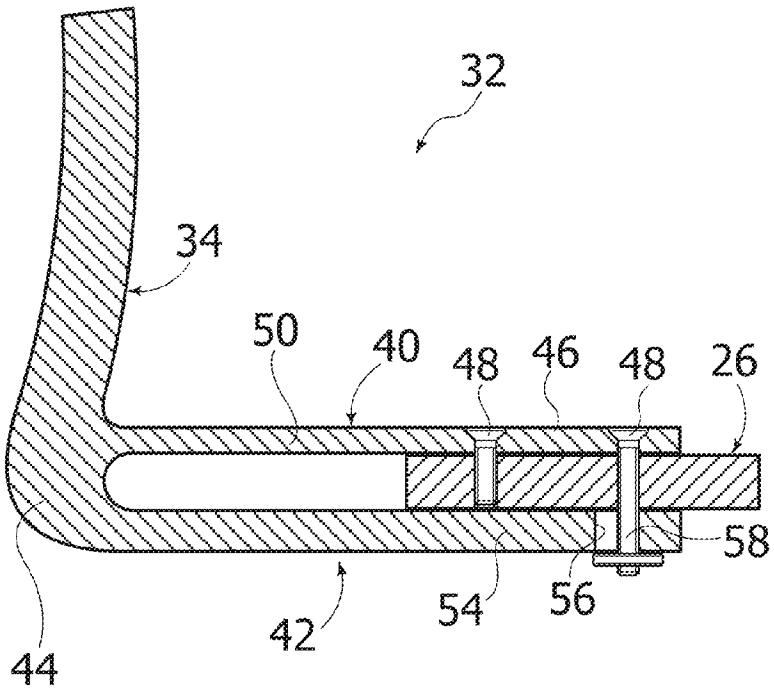

FIGS. 5 and 6 are schematic illustrations of the working principle of the joint 32. FIG. 5 illustrates the joint 32 in the resting position, corresponding to a resting position of the backrest 16. In FIGS. 5 and 6, the function of the pin 58 is performed by an end of one of the screws 48 that fix the front portion 46 of the first arm 40 to the bracket 26. In the resting position of FIG. 5, the pin 58 bears upon the front end of the slot 56.

Following upon a thrust backwards applied on the backrest 16 by the user, the first arm 40 undergoes elastic deformation, as illustrated in FIG. 6. This deformation of the first arm 40 causes an inclination backwards of the backrest 16. Simultaneously, the elastic bending of the first arm 40 causes a movement forwards of the front portion 54 of the second arm 42. FIG. 6 illustrates the position of the joint 32 corresponding to the position of maximum inclination backwards of the backrest 16. In this condition, the pin 58 bears upon the rear end of the slot 56, which defines an arrest that prevents a further bending of the first arm 40. The force applied by the user on the backrest 16 is compensated by a compression force on the second arm 42 against the arrest formed by the pin 58.

When the thrust backwards applied by the user ceases, the joint 32 returns into the resting position of FIG. 5 as a result of the elastic characteristics of the material constituting the joint 42. The leaf spring 52, if present, assists the action of elastic return and supplies a supplementary elastic force that counteracts the thrust backwards applied by the user against the backrest 16.

Figure 8:
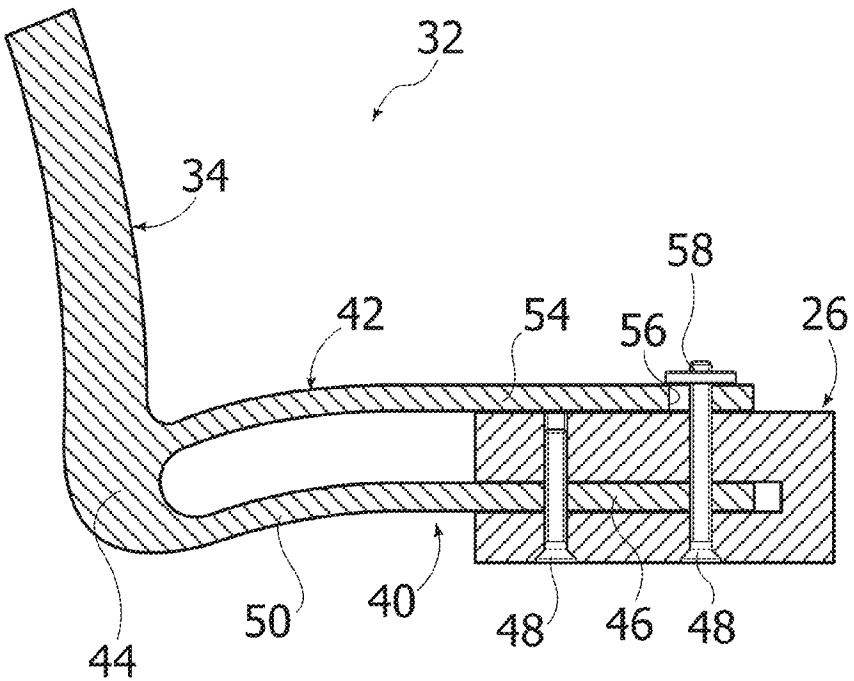
FIGS. 7 and 8 are schematic sections corresponding to those of FIGS. 5 and 6, which illustrate a variant of the present invention.
Figure 7:
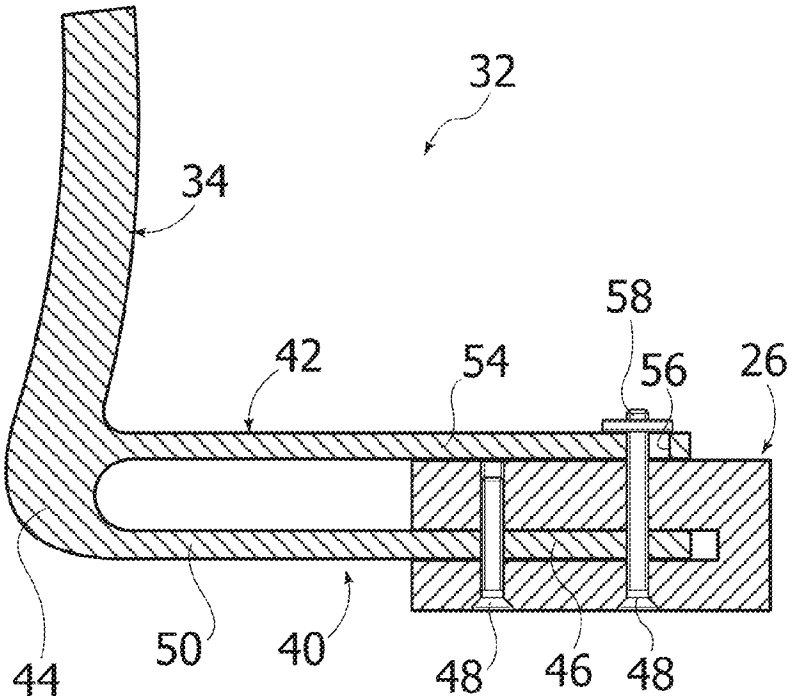

FIGS. 7 and 8 illustrate a variant of the joint 32 according to the present invention. In the embodiment described previously, the first arm 40 is in a higher position and the second arm is in a lower position. The same effect can be obtained by setting the first arm 40 (the one fixed with respect to the basic structure 12) in a lower position and the second arm 42 (the one that is mobile with respect to the basic structure 12) in a higher position, as illustrated in FIGS. 7 and 8. Operation of this variant is substantially identical to the one described previously, with the difference that in this case the second arm 42 is subjected to a tensile force in the position of maximum inclination backwards of the backrest (FIG. 8) instead of to a force of compression as in the case described previously.

Figure 9:
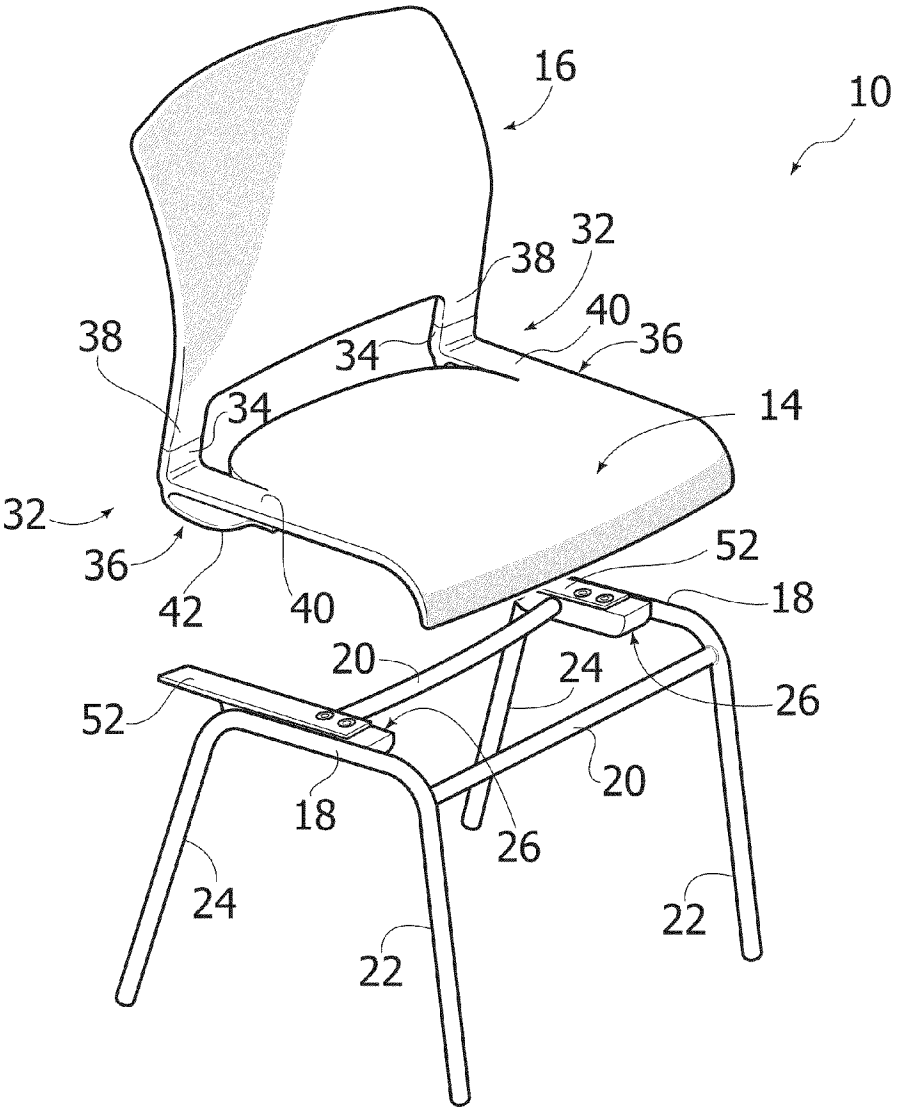
FIG. 9 is an exploded perspective view, which illustrates a second embodiment of the present invention.

FIG. 9 illustrates a second embodiment of a chair according to the invention. The elements corresponding to the ones described previously are designated by the same reference numbers.

In the variant of FIG. 9, the second connection portions 36 of the joints 32 are formed integrally with the seat 14. More precisely, the first arms 40 of the joints 32 are formed by elastically deformable lateral portions of the seat 14 that project in cantilever fashion towards the rear part. The second arms 42 of the joints 32 are formed as described previously. The second connection portions 36 of the joints 32 are connected to the basic structure 12 via the seat 14.

As in the embodiment described previously, the first connection portions 34 of the joints 32 can be formed integrally with the bottom lateral portions of the backrest 16, or else the first connection portions 34 can be inserted and fixed within respective bottom lateral portions 38 of the backrest 16.

Figure 10:
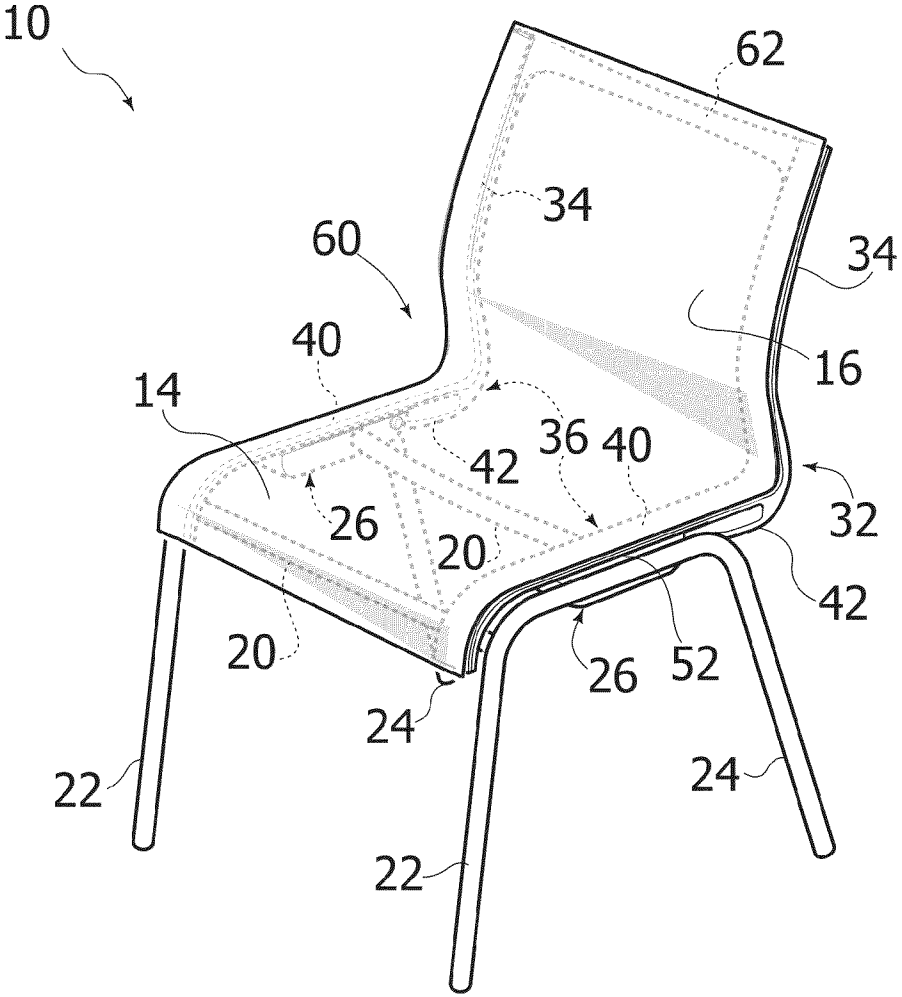
FIG. 10 is a perspective view, which illustrates a third embodiment of the invention.
Figure 11:
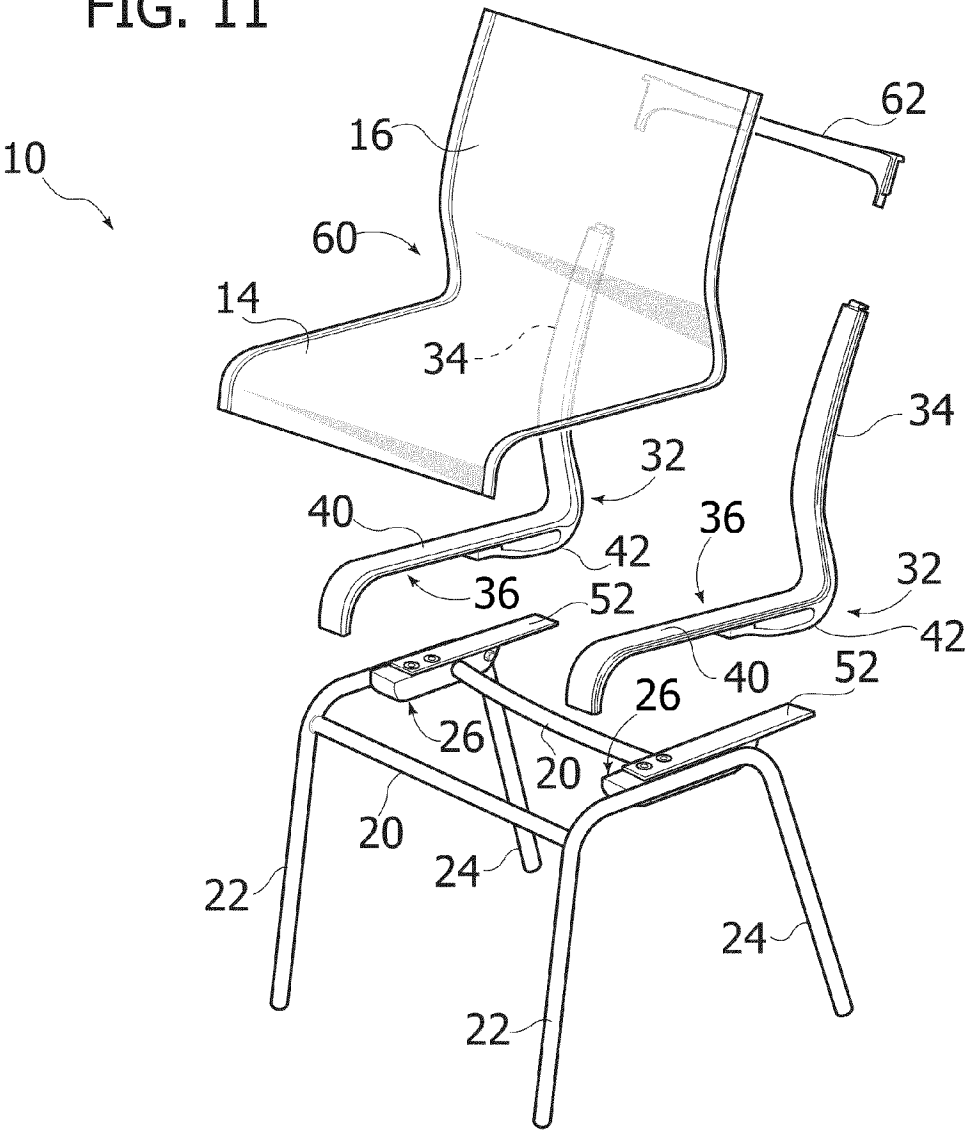
FIG. 11 is an exploded perspective view illustrating a third embodiment of the invention.

Illustrated in FIGS. 10 and 11 is a third embodiment of a chair according to the invention. The elements corresponding to the ones described previously are designated by the same reference numbers.

In the embodiment of FIGS. 10 and 11, the seat 14 and the backrest 16 are formed by a flexible canvas 60, the lateral edges of which are anchored to respective lateral supports formed by the joints 32. In particular, the first connection portions 34 of the joints 32 form two uprights, anchored to which are the lateral edges of the portion of canvas 60 forming the backrest 16, and the first arms 40 of the joints 32 form two horizontal supports, anchored to which are the lateral edges of the portion of canvas 60 forming the seat 14. The second arms 42 of the second connection portions 36 are made as described previously with reference to FIGS. 1-3.

The first connection portions 34 extend substantially throughout the height of the backrest 16, and the first arms 40 of the second connection portions extend substantially throughout the length of the seat 14.

A cross-member 62 forms the top edge of the backrest 16 and is fixed to the top ends of the first connection portions 34.

Also in this embodiment leaf springs 52 can be provided to assist the action of elastic return of the joints 32.

While the foregoing is directed to embodiments of the present invention, other and further embodiments of the invention may be devised without departing from the basic scope thereof, and the scope thereof is determined by the claims that follow.

The invention claimed is:

1. A chair comprising a basic structure, a seat, a backrest, and at least one joint made of plastic material, which connects the backrest to the basic structure, wherein the joint has a first connection portion fixed to or integral with respect to the backrest, and a second connection portion connected to the basic structure, and wherein the joint is elastically deformable to enable a movement of the backrest between a resting position and a position tilted backwards under a thrust backwards applied by a user, wherein said second connection portion comprises a first arm and a second arm, which are elongated in a longitudinal direction and are set at a distance from one another in a vertical direction, wherein the first and second arms have respective rear ends joined to a bottom end of said first connection portion, wherein the first arm is deformable between a resting position corresponding to the resting position of the backrest and a deformed position corresponding to the position where the backrest is tilted backwards, wherein the second arm has a front portion, which is mobile in a longitudinal direction with respect to the basic structure between a first position corresponding to the resting position of the first arm and a second position corresponding to the deformed position of the first arm, and wherein the second arm and the basic structure are provided with respective arrest elements, which limit the extent of the travel in a longitudinal direction of the front portion of the second arm and define an end-of-travel of tilting backwards of the backrest.

2. The chair according to claim 1, wherein said first arm is in a higher position than said second arm.

3. The chair according to claim 1, wherein said first arm is in a lower position than said second arm.

4. The chair according to claim 1, further comprising an elastic lamina of metal material associated to said first arm.

5. The chair according to claim 1, wherein said arrest elements comprise a pin-and-slit coupling.

6. The chair according to claim 2, wherein said pin-and-slit coupling comprises a slot elongated in a longitudinal direction formed in said front portion of the second arm and a pin fixed to said basic structure.

7. The chair according to claim 1, wherein the at least one joint comprises a first joint and a second joint, and wherein the seat and the backrest are formed by a flexible canvas, the lateral edges of which are anchored to respective lateral supports formed by the first and second joints.

8. The chair according to claim 7, wherein the first connection portions of the joints form two uprights, anchored to which are the lateral edges of the portion of canvas forming the backrest, and the first arms of the joints form two horizontal supports, anchored to which are the lateral edges of the portion of canvas forming the seat.

9. The chair according to claim 8, wherein the first connection portions extend substantially throughout the height of the backrest, and the first arms of the second connection portions extend substantially throughout the length of the seat.

10. The chair according to claim 8, wherein a cross-member forms the top edge of the backrest and is fixed to the top ends of the first connection portions.

11. The chair according to claim 1, wherein the basic structure comprises at least one bracket having a horizontal wall to which said front portion of said first arm is fixed.

12. The chair according to claim 11, wherein said first arm has a rear portion, which projects in cantilever fashion backwards from said bracket.

13. The chair according to claim 12, wherein the front portion of said second arm engages a longitudinal guide of said bracket as a sliding block.

14. The chair according to claim 12, wherein the at least one joint comprises a first joint and a second joint, and wherein the second connection portions of the first and second joints are formed integrally with the seat.

15. The chair according to claim 14, wherein the first arms of the joints are formed by elastically deformable lateral portions of the seat, which project in cantilever fashion towards the rear portion.

* * * * *